US008366889B2

(12) United States Patent
Hayashida

(10) Patent No.: US 8,366,889 B2
(45) Date of Patent: Feb. 5, 2013

(54) ANODE FOR ELECTROLYSIS AND MANUFACTURING METHOD THEREOF

(75) Inventor: Toshikazu Hayashida, Kanagawa (JP)

(73) Assignee: Permelec Electrode Ltd., Kanagawa (JP)

( * ) Notice: Subject to any disclaimer, the term of this patent is extended or adjusted under 35 U.S.C. 154(b) by 20 days.

(21) Appl. No.: 13/112,637

(22) Filed: May 20, 2011

(65) Prior Publication Data

US 2011/0290642 A1 Dec. 1, 2011

(30) Foreign Application Priority Data

May 25, 2010 (JP) ..... 2010-119245

(51) Int. Cl.
*C25B 11/08* (2006.01)
*C25B 11/06* (2006.01)

(52) U.S. Cl. ..... 204/290.14; 204/290.01; 204/290.12; 427/126.5; 427/331; 427/372.2; 427/379; 427/419.2; 427/419.3

(58) Field of Classification Search ..... 204/290.14, 204/290.01, 290.12; 427/126.5, 331, 372.2, 427/419.2, 419.3
See application file for complete search history.

(56) References Cited

U.S. PATENT DOCUMENTS

| | | | |
|---|---|---|---|
| 3,645,862 | A | 2/1972 | Cotton et al. |
| 4,230,544 | A | 10/1980 | McRae |
| 4,242,185 | A | 12/1980 | McRae |
| 4,585,540 | A | 4/1986 | Beer et al. |
| 2006/0065125 | A1 | 3/2006 | Horiguchi et al. |

FOREIGN PATENT DOCUMENTS

| | | |
|---|---|---|
| EP | 0 437 178 A1 | 12/1990 |
| JP | 58-136790 | 8/1983 |
| JP | 62-240780 | 10/1987 |
| JP | 62-243790 | 10/1987 |
| JP | 06-060193 | 8/1994 |
| JP | 2001-117165 | 4/2001 |
| JP | 2006-91612 | 4/2006 |

OTHER PUBLICATIONS

Yi et. al.; "Effect of Ir02 loading on Ru02-Ir02-Ti02 anodes; A study of microstructure and working life for the chlorine evolution reaction" Ceramics International, Elsevier, Amsterdam, NL vol. 33, No. 6, Jun. 25, 2007, pp. 1087-1091, XPO22127750, ISSN: 0272-8842, DOI: 10.1016/3, Ceramint 2006.03.025.

*Primary Examiner* — Bruce Bell
(74) *Attorney, Agent, or Firm* — Hamre, Schumann, Mueller & Larson, P.C.

(57) ABSTRACT

Subject
The present invention aims to provide an anode for electrolysis by an ion exchange membrane process and the manufacturing method thereof which can show a lower concentration of by-product oxygen gas in chlorine gas and a lower overvoltage stably for a long time, compared with conventional anodes.
Solution to Problem
The present invention is to prepare an anode for electrolysis, comprising a substrate comprising titanium or titanium alloy and a plurality of coating layers provided by the thermal decomposition baking method on the surface of the substrate, wherein the coating layer comprises the first coating layer comprising a mixture of iridium oxide, ruthenium oxide and titanium oxide, provided on the surface of the substrate, the second coating layer comprising a mixture of platinum and iridium oxide, provided on the first coating layer, a unit layer comprising the first coating layer and the second coating layer, provided on the surface of the second coating layer by a single or a plurality of layer, and the second coating layer, provided on the outermost layer of the unit layer; the plurality of layer is provided on the surface of the substrate by means of the thermal decomposition baking method and the coating layer is followed by post-baking at a higher baking temperature than the formerly applied in the thermal decomposition baking method.

10 Claims, 4 Drawing Sheets

【Fig.1】
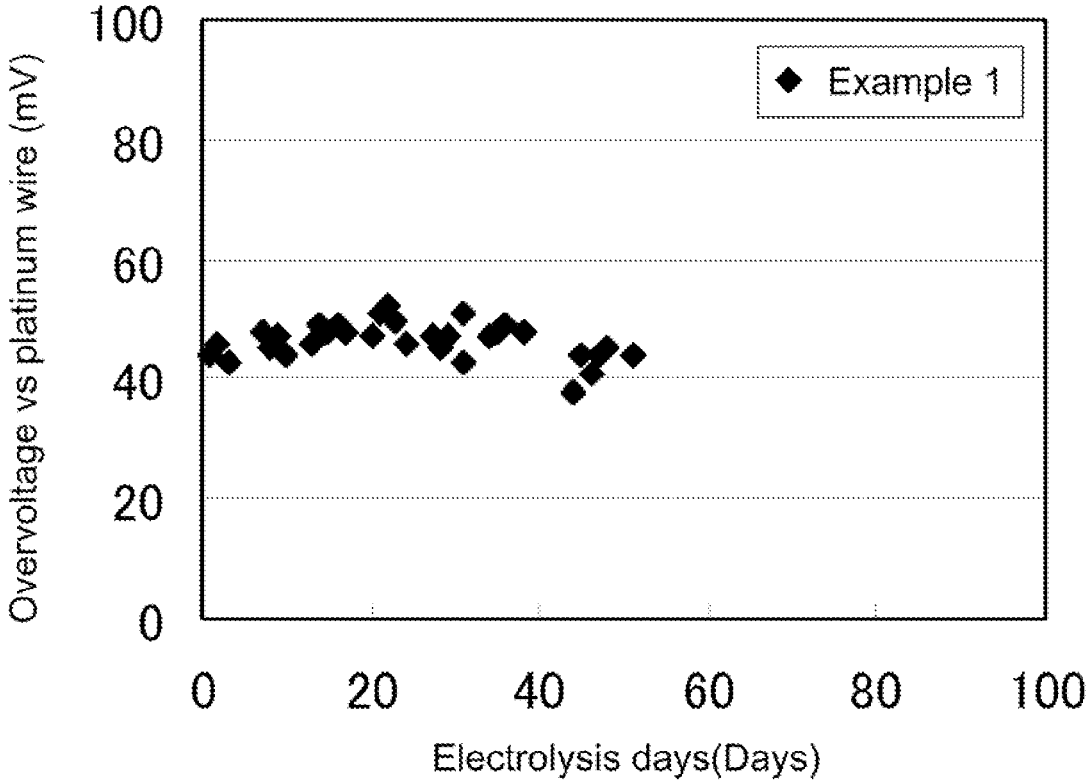

【Fig.2】
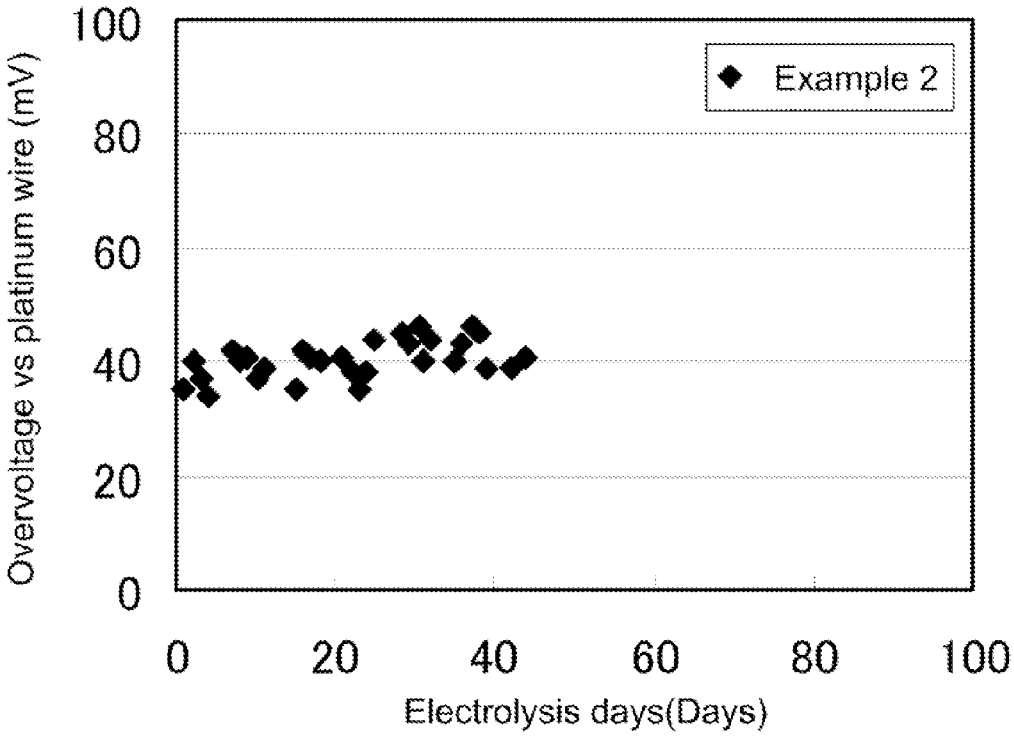

【Fig.3】
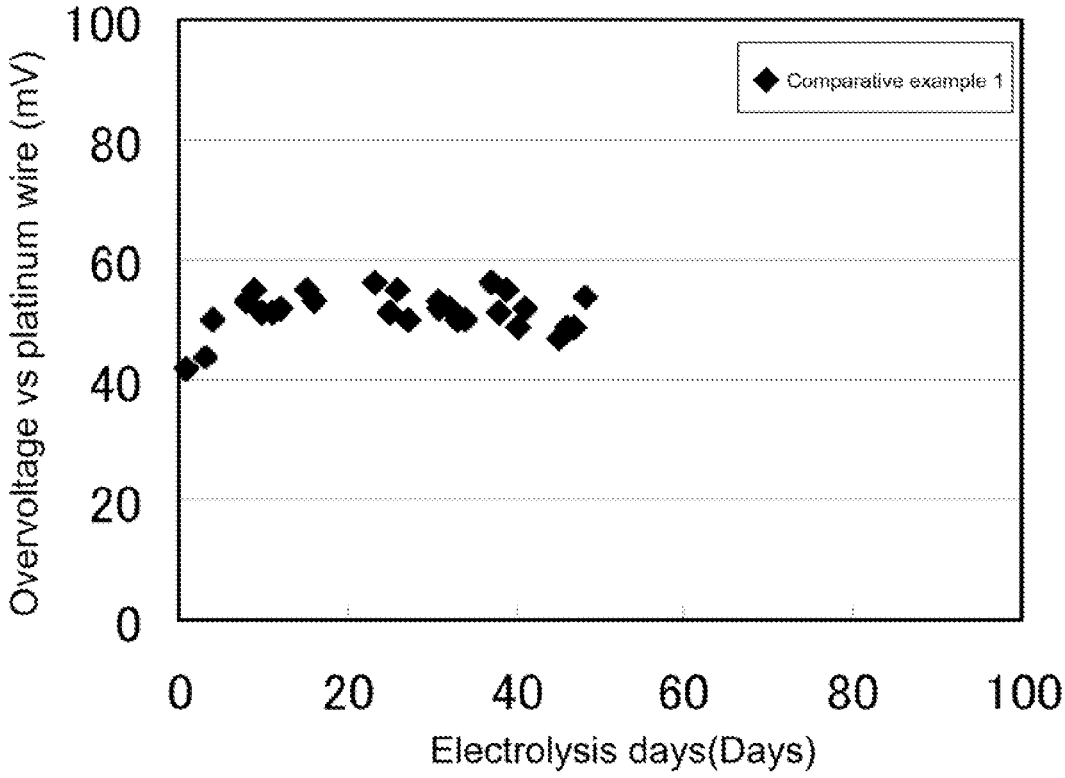

【Fig.4】
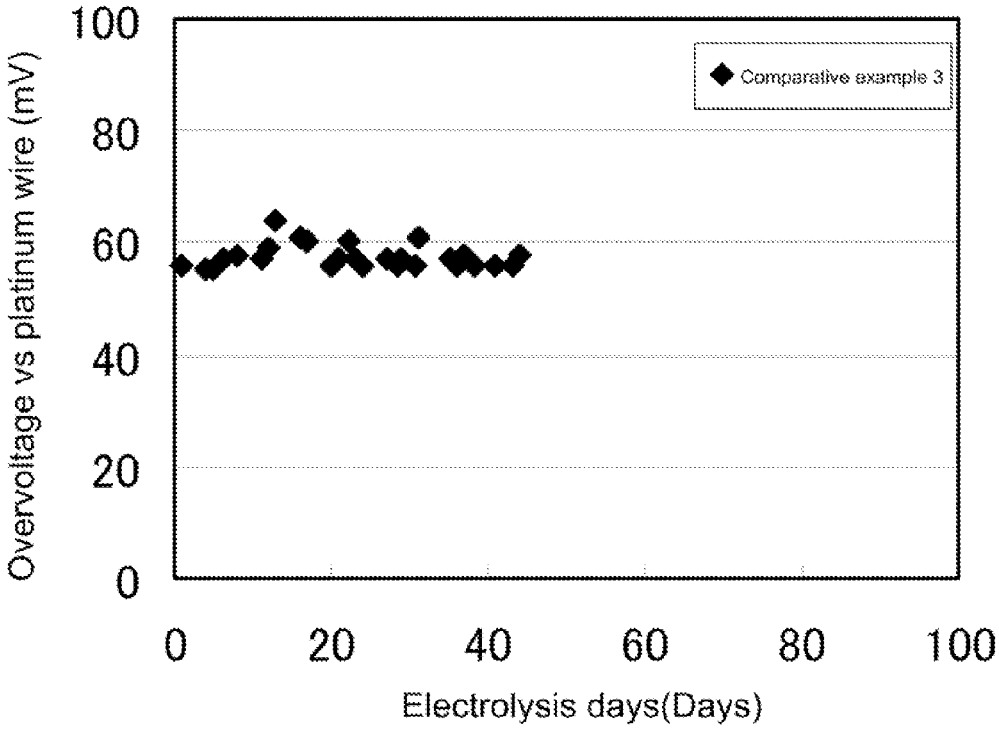

ANODE FOR ELECTROLYSIS AND MANUFACTURING METHOD THEREOF

CROSS-REFERENCE TO RELATED APPLICATIONS

This application is based upon and claims the benefit of priority of Japanese Patent Application 2010-119245, filed on May 25, 2010; the entire contents of which are incorporated herein by reference.

BACKGROUND OF THE INVENTION

1. Field of the Invention

The present invention relates to an anode for various electrolyses, which is especially desirable as an anode for an electrolytic cell for the manufacture of chlorine-alkali and chloric acid alkali, and for sea water electrolysis, and a manufacturing method thereof.

2. Description of the Related Art

Recently, such cases have been reported as problematic that with the brine electrolytic cell by the ion exchange membrane process, liquefaction cost for enhancing purity of chlorine gas is high and a large amount of hydrochloric acid is added. In view of these, an anode is required which has a specification to evolve by-product oxygen gas at a concentration lower than that by conventional anodes. The reaction process for the evolution of by-product oxygen is as follows:

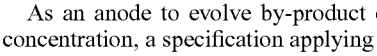

$$H_2O \rightarrow 2H + 1/2O_2 + 2e$$

As an anode to evolve by-product oxygen gas at a low concentration, a specification applying platinum component is promising. Conventionally, the following anodes for electrolysis by a specification applying platinum component have been reported, which comprises:

an anode having the first coating layer of platinum-iridium oxide mixture, on which the second coating layer by a mixture of 2~50 mass % of manganese oxide containing non-stoichiometric compound, expressed as MnOx (x being 1.5 or more but less than 2.0) and 50-98 mass % of titanium oxide having a rutile structure is provided (Patent Document 1); an anode having the first coating layer by a mixture of 20~80 mol. % of platinum and 20~80 mmol. % of iridium oxide having a rutile structure and the second coating layer by a mixture of 3~15 mol. % of iridium oxide having a rutile structure, 5~25 mol. % of ruthenium oxide and 60~92 mol. % of titanium oxide, these two layers constituting a unit layer, the anode being provided with a single, or a plurality of the unit layer (Patent Document 2); and an anode having the first coating layer by a mixture of 20~80 mol. % of platinum and 20~80 mol. % of iridium oxide having a rutile structure and the second coating layer by a mixture of 3~15 mol. % of iridium oxide having a rutile structure and 5-25 mol. % of ruthenium oxide and 60-92 mmol. % of tin oxide, these two layers constituting a unit layer; the anode being provided with a single, or multiple numbers of the unit layer (Patent Document 3).

However, further improvement is required for these anodes, because they bear such problems with long-time stability as a selective consumption of platinum, passivation or insufficient durability

Patent Literature

[Patent Document 1] Japanese Unexamined Patent Application Publication No. 58-136790

[Patent Document 2] Japanese Unexamined Patent Application Publication No. 62-240780

[Patent Document 3] Japanese Unexamined Patent Application Publication No. 62-243790

SUMMARY OF THE INVENTION

Technical Problem

The present invention aims to provide an anode for electrolysis by an ion exchange membrane process and the manufacturing method thereof which can show a lower concentration of by-product oxygen gas, in chlorine gas and a lower overvoltage stably for a long time, compared with conventional anodes.

Solution to the Problems

The first means to solve the problems to achieve the above-mentioned aims by the present invention is to prepare an anode for electrolysis, comprising a substrate comprising titanium or titanium alloy and a plurality of coating layers provided by the thermal decomposition baking method on the surface of the substrate, wherein the coating layer comprises the first coating layer comprising a mixture of iridium oxide, ruthenium oxide and titanium oxide, provided on the surface of the substrate, the second coating layer comprising a mixture of platinum and iridium oxide, provided on the first coating layer, a unit layer comprising the first coating layer and the second coating layer, provided on the surface of the second coating layer by a single or a plurality of layer, and the second coating layer, provided on the outermost layer of the unit layer; the plurality of layer is provided on the surface of the substrate by means of the thermal decomposition baking method and the coating layer is followed by post-baking at a higher baking temperature than the formerly applied in the thermal decomposition baking method.

The second means to solve the problems by the present invention for the anode for electrolysis is a baking temperature applied in the range of 350 degrees Celsius~520 degrees.

The third means to solve the problems by the present invention for the anode for electrolysis is a post-baking temperature being higher than the formerly applied in the thermal decomposition baking method, to a temperature of 475 degrees Celsius~550 degrees Celsius.

The forth means to solve the problems by the present invention for the anode for electrolysis is the composition ratios of iridium, ruthenium and titanium of the first coating layer being in the range of 20~30 mol. %, 25~30 mol. %, and 40~55 mol. %, respectively.

The fifth means to solve the problems by the present invention for the anode for electrolysis is the composition ratios of platinum and iridium of the second coating layer being in the range of 60~80 mol. % and 20~40 mol. %, respectively.

The sixth means to solve the problems by the present invention is, in a manufacturing method of an anode for electrolysis provided with a plurality of coating layer on the surface of the substrate comprising titanium or titanium alloy by means of the thermal decomposition baking method, the manufacturing method for the anode for electrolysis characterized in steps, comprising:

1) a step to prepare the first coating layer comprising a mixture of iridium oxide, ruthenium oxide and titanium oxide by coating a mixing solution of iridium compound, ruthenium compound and titanium compound on the surface of substrate comprising titanium or titanium alloy by means of the thermal decomposition baking method for heat-baking;

2) a step to prepare the second coating layer comprising a mixture of platinum and iridium oxide by coating a mixing solution of platinum compound and iridium compound on the surface of the first coating layer by means of the thermal decomposition baking method for heat-baking;
3) a step to prepare a single or a plurality of unit layer comprising the first coating layer and the second coating layer on the surface of the second coating layer by the thermal decomposition baking method;
4) a step to prepare the second coating layer on the outermost layer of the unit layer by the thermal decomposition baking method; and
5) a step to provide a plurality of coating layer with post-baking at a higher baking temperature than the temperature of the thermal decomposition baking method.

The seventh means to solve the problems by the present invention is, in the manufacturing method of an anode for electrolysis, the baking temperature by the thermal decomposition baking method is in the range of 350 degrees Celsius~520 degrees Celsius.

The eighth means to solve the problems by the present invention is, in the manufacturing method of an anode for electrolysis, the post-baking temperature is higher than that by the thermal decomposition baking method, in the range of 475 degrees Celsius~550 degrees Celsius.

The ninth means to solve the problems by the present invention is, in the manufacturing method of an anode for electrolysis, the composition ratios of iridium, ruthenium and titanium of the first coating layer being in the range of 20~30 mol. % 25~30 mol. %, and 40~55 mol. %, respectively.

The tenth means to solve the problems by the present invention is, in the manufacturing method of an anode for electrolysis, the composition ratios of platinum and iridium of the second coating layer being in the range of 60~80 mol. % and 20~40 mol. %, respectively.

Advantageous Effect of the Invention

According to the present invention, a mixture layer of iridium oxide, ruthenium oxide, and titanium oxide as the first coating layer is provided on the surface of the substrate comprising titanium or titanium alloy; adherence between the coating layer and the substrate is improved by titanium in the substrate and titanium in the first coating layer; the second coating layer comprising a mixture of platinum and iridium oxide as the outermost coating layer is provided; and after a plurality of coating layer is formed by the thermal decomposition baking method, post-baking is applied at a higher baking temperature than that by the thermal decomposition baking method; and thereby the amount of by-product oxygen can be further reduced. Therefore, the present invention can provide a durable anode for electrolysis, keeping a low chlorine overvoltage and a high oxygen overvoltage, which the platinum-iridium oxide coating layer has and simultaneously suppressing a dissolution exfoliation phenomenon of expensive platinum group metals in the electrolyte. As a result, chlorine gas with a high purity can be obtained without dosing a large amount of hydrochloric acid to the electrolytic cells, eliminating a liquefaction treatment.

BRIEF DESCRIPTION OF THE DRAWINGS

FIG. 1 A variation of platinum overvoltage of the anode of Example 1 for electrolysis by the present invention FIG. 2 A variation of platinum overvoltage of the anode of Example 2 for electrolysis by the present invention FIG. 3 A variation of platinum overvoltage of the anode of Comparative Example 1 for electrolysis by the present invention FIG. 4 A variation of platinum overvoltage of the anode of Comparative Example 3 for electrolysis by the present invention

DETAILED DESCRIPTION OF THE INVENTION AND PREFERRED EMBODIMENTS

The following explains, in detail, the present invention.

In the present invention, as the first step, the surface of a substrate comprising titanium or titanium alloy is degreased and roughened on its surface with etching by acid treatment, blast treatment, etc. Then, a mixture solution of iridium compound, ruthenium compound, and titanium compound is coated on the surface of the substrate comprising titanium or titanium alloy by using a brush, roller, or spray or by dipping, followed by heat-baking treatment by the thermal decomposition baking method, to prepare the first coating layer comprising a mixture of iridium oxide, ruthenium oxide, and titanium oxide.

As an anode substrate, applicable shapes include plate, rod, expanded metal, and porous metal.

As the iridium compound, iridium trichloride, hexachloroiridate, ammonium hexachloroiridate, and sodium hexachloroiridate, etc. are used; as the ruthenium compound, ruthenium trichloride, hexachlororuthenate, etc. are used; and as titanium compound, titanium trichloride, titanium tetrachloride and butyl titanate are used. As solvent for the mixture solution, water, hydrochloric acid, nitric acid, ethyl alcohol, methyl alcohol, isopropanol, butyl alcohol, lavender oil, aniseed oil, linaloe oil, turpentine oil, toluene, methyl ether, ethylene ether, etc. are applicable. After being coated, the substrate is dried for several tens of minutes at a temperature of 60~200 degrees Celsius to evaporate the solvent and subjected to the heat treatment at 350 degrees Celsius~520 degrees Celsius for 10~20 minutes in an electric oven with air or oxygen atmosphere.

The primary feature of the present invention lies in providing the first coating layer comprising a mixture layer of iridium oxide, ruthenium oxide, and titanium oxide as a coating contacting the surface of the substrate comprising titanium or titanium alloy, which improves adherence of the coating layer to the substrate because of the titanium in the substrate and the titanium in the first coating layer. In the cited. Japanese Unexamined Patent Application Publications No. 58-136790, No. 62-240780 and No. 62-243790 (Patent Documents 1~3), platinum-iridium oxide layer is applied as the layer contacting the surface of the substrate, but since titanium which is the same component as the substrate is not contained in that coating layer, adherence of that coating layer to the substrate is insufficient.

The first coating layer by the present invention is provided by the thermal decomposition baking method, to which a temperature of 350 degrees Celsius~520 degrees Celsius, is usually applied as the temperature of thermal decomposition baking. When the temperature of the thermal decomposition baking is below 350 degrees Celsius, thermal decomposition does not occur in full, and when it exceeds 520 degrees Celsius, the substrate is progressively oxidized and damaged. In addition, the composition ratios of iridium, ruthenium and titanium of the first coating layer are in, the range of 20~30 mol. %, 25~30 mol. %, and 40~55 mol. %, respectively.

Then, the second coating layer comprising a mixture of platinum and iridium oxide is provided on the surface of the first coating layer by coating, a mixture of platinum compound and iridium compound. The temperature of the thermal decomposition baking is the same as, applied to the first coating layer. The composition ratios of platinum and iridium of the second coating layer are in the range of 60~80 mol. % and 20~40 mol. %, respectively.

The second coating layer is formed on the surface of the first coating layer in such a manner that a mixture solution of platinum compound including hexachloroplatinate, ammonium hexachloroplatinate, potassium hexachloroplatinate, diammine dimitro platinum and iridium compound including iridium trichloride and hexachloroiridate is coated on the surface of the first coating layer, followed by baking.

As the solvent, water, hydrochloric acid, nitric acid, ethyl alcohol, methyl alcohol, propyl alcohol, butyl alcohol, methyl ether, ethyl ether, etc. are applied.

After the coating, the substrate is dried for several tens of minutes at a temperature of 60~200 degrees Celsius to evaporate the solvent, and treated in an electric oven with air or oxygen atmosphere at a temperature of 350 degrees Celsius~520 degrees Celsius for 10~20 minutes for thermal decomposition of these compounds.

Then, a unit layer comprising the first coating layer and the second coating layer is provided on the surface of the second coating layer by a single layer or a plurality of layer, by the thermal decomposition baking method. It is preferable for the unit layer comprising the first coating layer and the second coating layer to be piled by 2~3 layers.

The secondary feature of the present invention, is providing the second coating layer comprising a mixture of platinum and iridium oxide as the outermost layer of the coating layers; thereby the amount of by-product oxygen can be further reduced with simultaneous effect of reduced overvoltage.

In cited Japanese Unexamined Patent Application Publications No. 62-240780 and No. 62-243790 (Patent Documents 2 and 3) a mixture layer of iridium oxide, ruthenium oxide, and titanium oxide is prepared as the outermost layer, but in these cases, the amount of by-product oxygen is proven to be large.

Successively, a plurality of coating layer is subject to the post-baking at a higher temperature than the baking temperature by the thermal decomposition baking method. It is desirable that the post-baking temperature is higher than the baking temperature, preferably, at a temperature of 475 degrees Celsius~550 degrees Celsius. When the post-baking temperature exceeds 550 degrees Celsius, it is feared that overvoltage rises.

The tertiary feature of the present invention is post-baking which is added after the formation of a plurality of coating layer by the thermal decomposition baking method, at a temperature higher than the baking temperature by the thermal decomposition baking method; thereby the amount of by-product oxygen is further reduced.

In cited Japanese Unexamined Patent Application Publications No. 62-240780 and No. 62-243790 (Patent Documents 2 and 3), post-baking is not performed and neither the amount of by-product oxygen nor the overvoltage decreased.

EXAMPLES

The following explains examples of the present invention; however the present invention shall not be limited to these examples.

Example 1

The substrate is a titanium mesh (6.0 mm long×3.5 mm wide×1 mm thick). As, the pretreatment, the substrate is conditioned by annealing for 60 minutes at 590 degrees Celsius, followed by sufficient surface-roughening with alumina particles, and etching treatment in a boiling 20 mass % hydrochloric acid.

The coating solution 1 was prepared, using hydrochloric acid and isopropanol as the solvent, and ruthenium trichloride, iridium trichloride, titanium trichloride and titanium tetrachloride as the metal material at a composition ratio of 25 mol. % of ruthenium, 25 mol. % of iridium, and 50 mol. % of titanium.

Then, the coating solution 2 was prepared, using nitric acid as the solvent, and diammine dinitro platinum and iridium trichloride as the metal material at a composition ratio of 70 mol. % of platinum and 30 mol. % of iridium.

The coating solution 1 was applied on the surface of the titanium substrate, followed by drying at 60 degrees Celsius and baked for 15 minutes in an electric oven at 475 degrees Celsius to form the first coating layer of $IrO_2$—$RuO_2$—$TiO_2$.

On the surface of this substrate, the coating solution 2 was applied, followed by drying at 60 degrees Celsius and baked for 15 minutes in an electric oven at 475 degrees Celsius to form the second coating layer of Pt—$IrO_2$.

This first coating layer and the second coating layer were laminated alternately to form four layers, followed by the post baking treatment for 60 minutes at 520 degrees Celsius to manufacture an anode. The outermost layer was the Pt—$IrO_2$ layer; and the total coating amount, as metal, of the first coating layer was 2.32 g/m$^2$ and that of the second coating layer was 1.28 g/m$^2$.

In the two-compartment type brine electrolysis cell (200 g/L-NaCl, 90 degrees Celsius, pH=3) applying Aciplex F6801 (manufactured by Asahi Kasei Chemicals Corp.) as an ion exchange membrane, the concentration of by-product oxygen gas ($O_2/Cl_2$) of this anode Was measured. The gap between the ion exchange membrane and the anode was 22 mm. As a result, $O_2/Cl_2$, which is the amount of by-product oxygen Was 0.08 vol. % at 40 A/dm$^2$ of the current density, as shown in Table-1. Aciplex is a registered trademark of Asahi Kasei Chemicals Corp.

Then, overvoltage was evaluated using, the two-compartment type brine electrolysis cell (170 g/L-NaCl, 90 degrees Celsius, zero gap) applying Flemion F8020 (manufactured by Asahi Glass Co., Ltd) as an ion exchange membrane. Overvoltage was evaluated as a value of platinum wire probe. As a result, the overvoltage at 60 A/dm$^2$ was 44 mV (vs. platinum wire), as shown in Table-1. Flemion is a registered trademark of Asahi Glass Co., Ltd.

According to Example 1, the $O_2/Cl_2$, which is the amount of by-product oxygen could be kept extremely low, and the overvoltage also be maintained at a low level in a continuous electrolysis operation, as above-mentioned,

Example 2

In the same manner with Example 1, an anode was manufactured, in which the total coating amount, as metal was 2.06 g/m$^2$ for the first coating layer and 1.06 g/m$^2$ for the second coating layer.

The amount of by-product oxygen, $O_2/Cl_2$, was measured in the same cell as Example 1, and the result was 0.06 vol. %.

Also, overvoltage was evaluated in the same cell as Example 1, the result was 35 mV (vs platinum wire)

As with Example 1, the amount of by-product oxygen was extremely low and the overvoltage also was low.

Comparative Example 1

An anode was prepared in the same manner as Example 1 except that the post baking treatment at 520 degrees Celsius for 60 minutes was not applied.

In the same cell as with Example 1, $O_2/Cl_2$ of this anode was measured. As a result, the $O_2/Cl_2$, which is the amount of by-product oxygen was 0.13 vol. %, as shown in Table-1, which was higher than Example 1, proving the effect of the post baking treatment on a low $O_2/Cl_2$.

Also, in the same cell as with Example 1, overvoltage was evaluated. As a result, the overvoltage was 42 mV (vs platinum wire), as shown in Table-1. Though the initial value was equivalent to Example 1, the measured value increased with time to around 50 mV.

Comparative Example 2

The substrate and the pretreatment process are the same as Example 1. In the coating process, the first coating layer and the second coating layer are laminated alternately to form three layers, followed by additionally forming the first coating layer to manufacture an anode with an iridium oxide-ruthenium oxide-titanium oxide layer as the outermost layer. The post baking treatment was not performed.

The total coating amount, as metal was 2.32 g/m$^2$ for the first coating layer and 0.96 g/m$^2$ for the second coating layer.

In the same cell with Example 1, the $O_2/Cl_2$, which is the amount of by-product oxygen of this anode, was measured. As a result, the $O_2/Cl_2$ was 0.20 vol. %, as shown in Table-1, giving a higher value than Example 1 and Comparative Example 1. The overvoltage at 60 A/dm$^2$ in the continuous electrolysis could not be measured.

Comparative Example 3

An anode was manufactured in the same manner as with Comparative Example 2, but the post baking treatment for 60 minutes at 520 degrees Celsius was added.

In the same cell with Example 1, the $O_2/Cl_2$, which is the amount of by-product oxygen of this anode, was measured. As a result, the $O_2/Cl_2$ was 0.07 vol. %, as shown in Table-1, giving a low value, but the overvoltage, evaluated in the same cell with Example 1, was as high as 56 mV (vs platinum wire).

Table-1 summarizes all results from Example 1, Example 2, Comparative Example 1, Comparative Example 2, and Comparative Example 3. From the results in Table-1, the following are elucidated. From comparisons between Examples 1, 2 and Comparative Example 1 or between Comparative Example 2 and Comparative Example 3, the by-product oxygen amount can be decreased by applying post-baking at a temperature higher than the baking temperature.

Also, from comparisons between Example 1, 2 and Comparative Example 3, overvoltage is lower when the second coating layer comprising the platinum-iridium oxide is the outermost layer than, when the first coating layer comprising iridium oxide-ruthenium oxide-titanium oxide is the outmost layer, and therefore, the platinum-iridium oxide layer is advantageous as the outermost layer.

TABLE 1

| | | example 1 | example 2 | comparative example 1 | comparative example 2 | comparative example 3 |
|---|---|---|---|---|---|---|
| specifications | the first coating layer | $IrO_2$—$RuO_2$—$TiO_2$ | $IrO_2$—$RuO_2$—$TiO_2$ | $IrO_2$—$RuO_2$—$TiO_2$ | $IrO_2$—$RuO_2$—$TiO_2$ | $IrO_2$—$RuO_2$—$TiO_2$ |
| | the outermost layer | Pt—$IrO_2$ | Pt—$IrO_2$ | Pt—$IrO_2$ | $IrO_2$—$RuO_2$—$TiO_2$ | $IrO_2$—$RuO_2$—$TiO_2$ |
| | the first coating layer coating amount (g/m$^2$) | 2.32 | 2.06 | 2.32 | 2.32 | 2.32 |
| | the second coating layer coating amount (g/m$^2$) | 1.28 | 1.06 | 1.28 | 0.96 | 0.96 |
| | baking post baking | 520° C. × 60 minutes | 520° C. × 60 minutes | 475° C. × 15 minutes none | none | 520° C. × 60 minutes |
| initial performance | by-product oxygen amount $O_2/Cl_2$ (vol. %) | 0.08 | 0.06 | 0.13 | 0.20 | 0.07 |
| | overvoltage in a continuous electrolysis operation vs. platinum wire (mV) | 44 | 35 | 42 | — | 56 |
| | notes | by-product oxygen amount be kept extremely low, and overvoltage be maintained at a low level | by-product oxygen amount be kept extremely low, and overvoltage be maintained at a low level | by-product oxygen amount be maintained at somewhat much | by-product oxygen amount be maintained at many | overvoltage be maintained at somewhat high |

Change in overvoltage of the anodes manufactured in Example 1, Example 2, Comparative Example 1 and Comparative Example 3 when operated continuously under accelerating conditions is shown in FIG. 1, FIG. 2, FIG. 3, and FIG. 4, respectively. The anodes of Examples 1 and 2 maintained a low value of overvoltage for a long time, but the anodes of Comparative Examples 1 and 3 gave a high value of overvoltage.

Industrial Applicability

The present invention can be utilized to provide a durable anode for electrolysis, keeping a low chlorine overvoltage and a high oxygen overvoltage, which a platinum-iridium oxide coating layer has, and simultaneously suppressing a dissolution exfoliation phenomenon of expensive platinum group metals in the electrolyte.

The invention claimed is:

1. An anode for electrolysis, comprising:

a substrate comprising titanium or titanium alloy, and a plurality of coating layer provided on the surface of the substrate by the thermal decomposition baking method, wherein the coating layer comprising:

the first coating layer comprising a mixture of iridium oxide, ruthenium oxide and titanium oxide, provided on the surface of the substrate, the second coating layer comprising a mixture of platinum and iridium oxide, provided on the first coating layer, a unit layer comprising the first coating layer and the second coating layer, provided on the surface of the second coating layer by a single or a plurality of layer, and the second coating layer, provided on the outermost layer of the unit layer, characterized in that a plurality of coating layer is provided on the surface of the substrate by means of the thermal decomposition baking method, followed by post-baking at a baking temperature higher than that by the thermal decomposition baking method.

2. The anode for electrolysis according to claim 1, wherein the baking temperature by the thermal decomposition baking method is 350 degrees Celsius~520 degrees Celsius.

3. The anode for electrolysis according to claim 1, wherein the post-baking temperature is higher than the temperature by the thermal decomposition baking method, to a temperature range of 475 degrees Celsius~550 degrees Celsius.

4. The anode for electrolysis according to claim 1, wherein the composition ratios of iridium, ruthenium and titanium of the first coating layer are in the range of 20~30mol. % , 25~30mol. %, and 40~55mol. % , respectively.

5. The anode for electrolysis according to claim 1, wherein the composition ratios of platinum and iridium of the second coating layer are in the range of 60~80mol. % and 20~40mol. %, respectively.

6. A manufacturing method of an anode for electrolysis provided with a plurality of coating layer on the surface of the substrate comprising titanium or titanium alloy by means of the thermal decomposition baking method, characterized in steps, comprising:

1) a step to prepare the first coating layer comprising a mixture of iridium oxide, ruthenium oxide and titanium oxide by coating a mixing solution of iridium compound, ruthenium compound and titanium compound on the surface of the substrate comprising titanium or titanium alloy by means of the decomposition baking method for heat-baking;

2) a step to prepare the second coating layer comprising a mixture of platinum and iridium oxide by coating a mixing solution of platinum compound and iridium compound on the surface of the first coating layer by means of the thermal decomposition baking method for heat-baking;

3) a step to prepare a single or a plurality of unit layer comprising the first coating layer and the second coating layer on the surface of the second coating layer by the thermal decomposition baking method;

4) a step to prepare the second coating layer on the outermost layer of the unit layer by the thermal decomposition baking method; and 5) a plurality of coating layer being subject to post-baking at a higher baking temperature than the temperature by the thermal decomposition baking method.

7. The manufacturing method of an anode for electrolysis according to claim 6, wherein the baking temperature by the thermal decomposition baking method is in the range of 350 degrees Celsius~520 degrees Celsius.

8. The manufacturing method of an anode for electrolysis according to claim 6, wherein the post-baking temperature is higher than that by the thermal decomposition baking method, in the range of 475 degrees Celsius~550 degrees Celsius.

9. The manufacturing method of an anode for electrolysis according to claim 6, wherein the composition ratios of iridium, ruthenium and titanium of the first coating layer are in the range of 20~30mol. % , 25~30mol. %, and 40~55mol. % , respectively.

10. The manufacturing method of an anode for electrolysis according to claim 6, wherein the composition ratios of platinum and iridium of the second coating layer are in the range of 60~80mol. % and 20~40mol. %, respectively.

* * * * *